United States Patent [19]

Desjobert et al.

[11] Patent Number: 4,499,707

[45] **Date of Patent: * Feb. 19, 1985**

[54] METHOD AND APPARATUS FOR BALING A TOW OF TEXTILE FILAMENTS

[75] Inventors: Gilles Desjobert, Brignais; André Jaillet, Geneuille, both of France

[73] Assignee: Rhone-Poulenc-Textile, Paris, France

[ * ] Notice: The portion of the term of this patent subsequent to Aug. 13, 1999 has been disclaimed.

[21] Appl. No.: 128,804

[22] Filed: Mar. 10, 1980

[30] Foreign Application Priority Data

Mar. 9, 1979 [FR] France ..... 79 06312

[51] Int. Cl.[3] ..... B65B 63/04

[52] U.S. Cl. ..... 53/429; 53/116; 53/255; 53/473; 493/411; 493/414

[58] Field of Search ..... 53/255, 429, 117, 116, 53/473; 493/411, 412, 413, 414, 410

[56] References Cited

U.S. PATENT DOCUMENTS 3,656,383 4/1972 Dibble et al. ..... 53/123 X
3,724,838 4/1973 Orlovsky ..... 493/413 X

FOREIGN PATENT DOCUMENTS 2534917 2/1977 Fed. Rep. of Germany ..... 53/429
1215558 12/1970 United Kingdom ..... 493/414

*Primary Examiner*—Gus T. Hampilos
*Attorney, Agent, or Firm*—Sherman & Shalloway

[57] ABSTRACT

A method and apparatus for baling a tow of textile filaments, in which when a container has been filled, the tow is cut automatically in such a way that the end of the cut tow connected to the tow in the container falls on the side of the container, the other end of the cut tow forming the beginning of the tow for the new container, being constantly gripped during the filling of the new container, at a location which is beyond the maximum oscillating portion of the tow laying guide. The gripped end is released after the new container has been completely filled.

8 Claims, 9 Drawing Figures

METHOD AND APPARATUS FOR BALING A TOW OF TEXTILE FILAMENTS

BACKGROUND OF THE INVENTION a—Field of the Invention

The present invention relates to a method and apparatus for baling a tow of textile filaments. It relates more particularly to the operation for cutting the tow after the container has been filled.

b—Description of the Prior-Art

After tows of continuous filaments of artificial and synthetic textiles have been produced, it is known to package them in containers, generally cartons, by an operation referred to as "baling". During this operation, the tow is laid in uniform layers by means of a laying device driven with a reciprocating movement above the carton, the latter itself being driven with a reciprocating movement in a direction perpendicular to that of the movement of the laying device. The combination of these two movements permits the uniform formation of several superposed layers of tow. At the end of the operation, namely when the carton is full, it is necessary to cut the tow and to proceed in such a way that the beginning and the end of the length of tow which has been laid are easily distinguished. To do this, the tow is cut by hand, generally with scissors, at the end of the filling operation, and, in order to prevent the opening and the tangling of the yarns at the two ends obtained, a knot is made on each of these ends. This operation takes time and the result is not very attractive. Sometimes the yarns at the cut ends are held together by means of an adhesive tape.

It is also known to cut the tow automatically when the container has been filled. Thus, according to U.S. Pat. No. 3,656,383, the tow of thermoplastic textile yarns is cut automatically by means of a heated blade. Cutting is effected at a point, on the tow, which is located between a full container, which has just been withdrawn from the charging position, and a container to be filled, which is located in the charging position. However, this method does not make it possible easily to distinguish the two ends of the baled length of tow, one of these ends being embedded at the bottom of the container. Furthermore, it is necessary for an operator to intervene in order to hold the yarns of the other end together.

SUMMARY OF THE INVENTION

According to one aspect of the present invention, there is provided a method of baling a tow of continuous textile filaments, comprising feeding the tow vertically through an oscillating laying guide, so that it is layed into a container and when the container has been filled, cutting the tow automatically in such a way that that end of the cut tow which is connected to the tow in the container falls over the side of the latter, the other end of the cut tow forming the beginning of the tow for a new container and being constantly gripped during the filling of the new container and released when the filling of the new container is complete.

Such a method makes it possible to carry out, very simply and effectively, the operation for cutting and holding the cut ends for the purpose of making them easily accessible.

The container is preferably changed automatically. With tows of thermoplastic textiles, the method can involve the use of a heated cutting blade and this causes cutting/welding of the ends, which makes it possible to hold the ends of the yarns together, thus preventing opening and tangling.

According to another aspect of the invention, we provide apparatus for baling a tow of textile filaments, said apparatus comprising at least one oscillating laying guide, means for feeding the tow vertically through said guide into a container, means for reciprocating the container in a direction perpendicular to that of the oscillation of the laying guide, and a device for automatically cutting the tow at the end of the operation for filling the container, the said cutting device comprising a fixed member for gripping the tow, located beyond the zone swept by the laying means, and a movable member for displacing the tow and bringing it to the fixed member, and fixed means for cutting the tow, which means is located downstream of the fixed member with respect to the direction of displacement of the tow. Advantageously, the gripping means consists of two jaws, one of which is fixed and the other of which can move and is controlled, for example, by a fluid pressure operated jack. The cutting means can consist of a cutting edge, but in the case of tows of thermoplastic textiles, it advantageously consists of a heated blade adjacent to the gripping means. The member for displacing the tow and bringing it to the fixed member can consist of at least one arm which is driven, with a pendular movement having an amplitude which is greater than the amplitude of the movement of the laying guide, between a rest position and a position of contact with the fixed member. This arm may comprise at least one element for displacing the tow downstream of the laying guide, an element for introducing the tow into the gripping means and an element for holding the tow against the cutting means, which holding element is located downstream of the element for introducing the tow.

According to a preferred embodiment, the laying guide comprises a funnel-shaped guide which is driven with a pendular movement, about a horizontal axle, by a suitable means such as a connecting rod/crank system. The member for displacing the tow and bringing it to the fixed member may then comprise at least two parallel arms which are located on either side of the funnel-shaped guide and pivot about the same axle as the guide. The two arms of the member for displacing the tow and bringing it to the fixed member may be rendered integral, on the one hand, by the pivoting axle at their upper part, and, on the other hand, by two parallel cylindrical bars at their lower part. These two bars constitute the means for displacing the tow and at the same time the means for holding it against the cutting blade. The movement of the member for displacing the tow and bringing it to the fixed member is produced by any suitable means and advantageously by a jack.

The baling device can comprise means for automatically changing the container.

The device according to the invention also comprises automatic means for controlling and synchronising:

- stopping and restarting the feed and the laying guide,
- setting in motion the member for seizing the tow and bringing it to the fixed member,
- opening and closing the jaws,
- starting and stopping the means for heating the cutting blade, and
- changing the container.

In order that the invention will be understood more clearly, the following description is given by way of illustration, but without implying any limitation, reference being made to the accompanying drawings.

DETAILED DESCRIPTION

Figure 1:
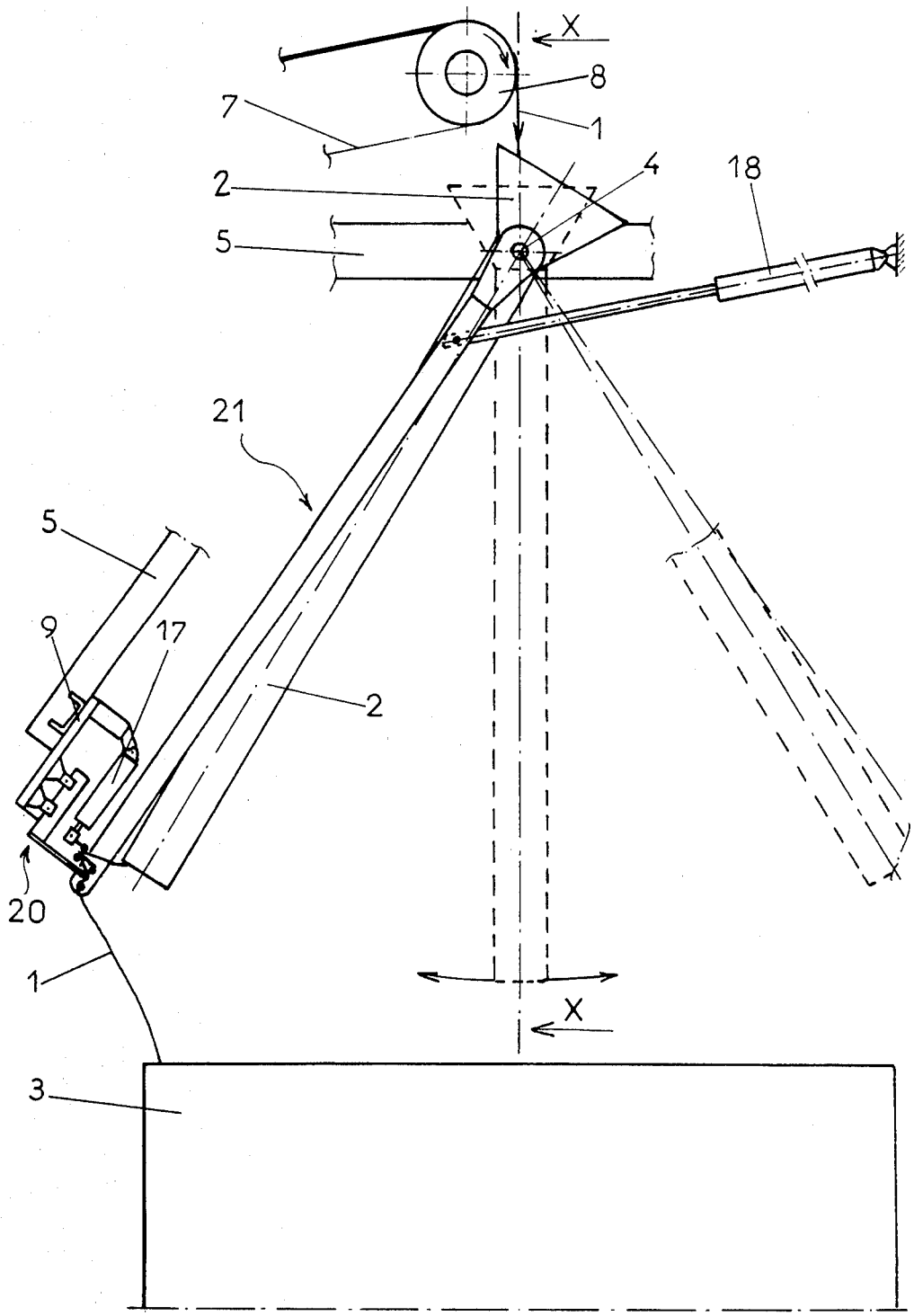
FIG. 1 is a schematic side elevation of one embodiment of a baling device according to the invention.

The illustrated apparatus is intended for tows of thermoplastic textiles.

With reference to FIGS. 1 to 4, there may be seen, on the baling device shown, a funnel-shaped guide 2 for laying the tow 1 in a container 3 which is commonly a carton. The guide 2 is driven with a pendular movement, e.g. by a connecting rod-crank system (not shown), about a horizontal axle 4 supported by the frame 5 of the baling device. The carton 3 is arranged on a plate 6 which is driven with a reciprocating movement in the direction of the arrows a (FIG. 4), perpendicular to the direction of movement of the guide 2. This reciprocating movement is provided by a suitable means which is not shown, such as a connecting rod/-crank system. The tow 1 is fed to the laying guide 2 by means of an apron feed 7 passing over a roller 8.

An automatic cutting device for cutting the tow consists of a fixed member 20, integral with the frame 5, and of a movable member 21 for seizing the tow and bringing it to the fixed member.

Figure 2:
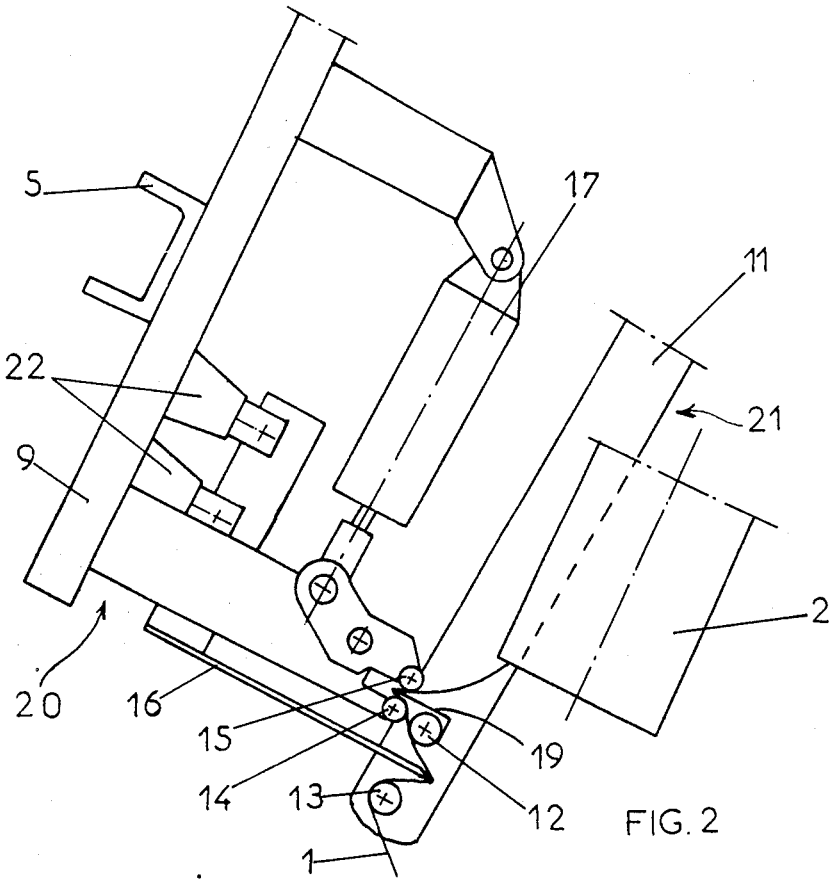
FIG. 2 is an enlarged view, showing the cutting device of FIG. 1 in detail.
Figure 3:
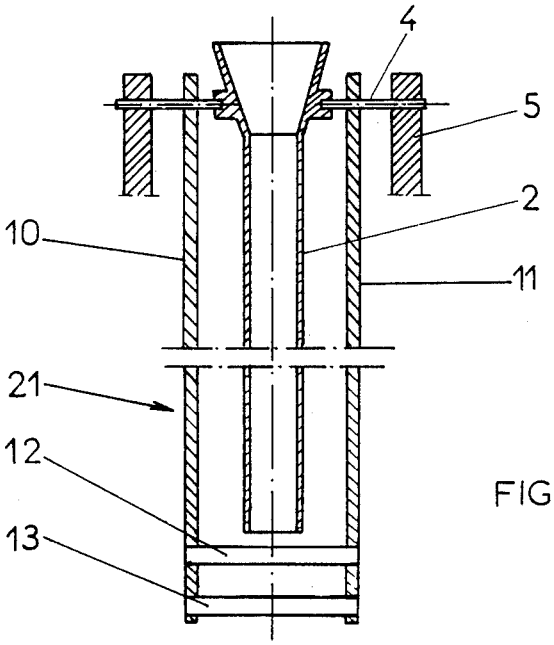
FIG. 3 is a section taken along line X—X of FIG. 1, illustrating the guide.
Figure 4:
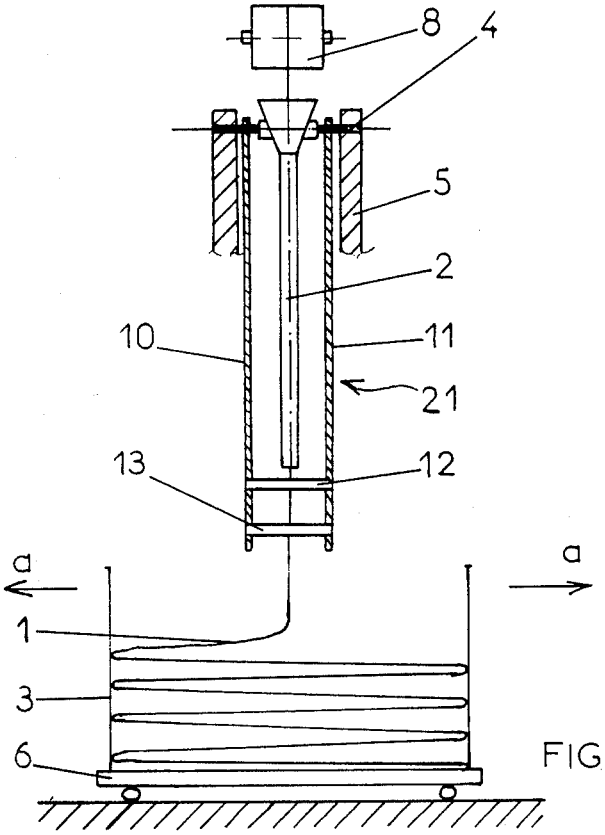
FIG. 4 is a similar view showing the guide in position in the apparatus.

The cutting device can be seen more clearly in FIGS. 2 and 3. The movable member 21 comprises two parallel arms 10 and 11 which are integral with the axle 4, the said axle pivoting in the frame 5, and are located on either side of the guide 2. The length of the arms 10 and 11 from the axle 4 to their lower end is greater than the length of the guide 2. At their lower part, the arms 10 and 11 are joined by two parallel bars 12 and 13 which constitute the means for seizing the tow at the outlet of the guide 2, and at the same time the means for holding the tow against the fixed member of the cutting device. The fixed member 20 of the cutting device is shown in detail in FIG. 2, in which the arm 10 of the movable member 21 has been removed for clarity. The fixed member 20 is integral with the frame 5 and it is positioned at a point located beyond the zone swept by the guide 2, which is shown at the end of its stroke in FIGS. 1 and 2. The fixed member 20 comprises a gripping means, consisting of a fixed jaw 14 and a movable jaw 15 actuated by a cylinder 17, and an electrically heated cutting blade 16. The jaws 14 and 15, the blade 16 and the cylinder 17 are mounted on a support 9 carried by the frame 5, the blade 16 being mounted on insulators 22. The pendular movement of the movable member 21 is controlled by a fluid pressure operated jack 18 (FIG. 1), one end of which is fixed to the frame 5. The amplitude of the movement, which is greater than that of the movement of the guide 2, corresponds to the position of the fixed member 20 with which the movable member 21 comes into contact. The movable member 21 is completed by a non-cutting blade 19 for introducing the tow 1 between the jaws 14 and 15. In the illustrative embodiment, the blade 19 is fixed to the bar 12. In a known manner, the baling device is equipped with automatic means (not shown) for changing the container 3.

The apparatus also comprises automatic means, which are not shown, for controlling and synchronising the various operations involved. These operations are:

- stopping and restarting the feed (apron 7) and the laying guide 2,
- setting in motion, by means of the jack 18, the member 21 for seizing the tow and
- bringing it to the cutting means,
- controlling the cylinder 17 for the movable jaw 15,
- starting and stopping the means for heating the blade 16, and
- changing the container 3.

The control and synchronisation means react according to the filling level in the container, which filling level depends on the setting of a metric counter for the length of tow.

MODE OF OPERATION OF THE INVENTION

Figure 9:
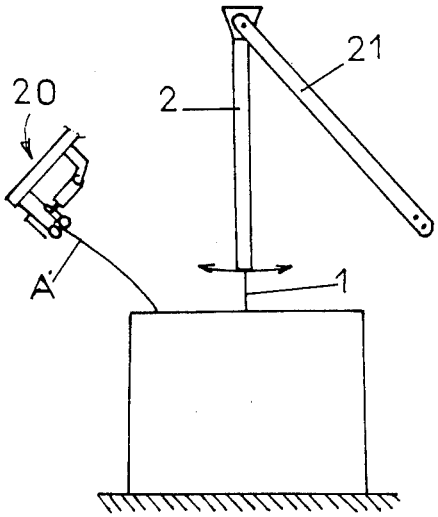

The cyclical manner in which the baling method takes place is illustrated in FIGS. 5 to 9, and is as follows:

As illustrated in FIG. 9, the downstream end A of the tow constituting the beginning of the baled tow is gripped between the jaws 14 and 15 as will be explained below. The guide 2 swings back and forth with its pendular motion, and the tow is layed into the container. When the container 3 is full, the metric counter for the length of tow triggers the starting of the automatic means for controlling and synchronising the subsequent operations of the cycle.

Figure 5:
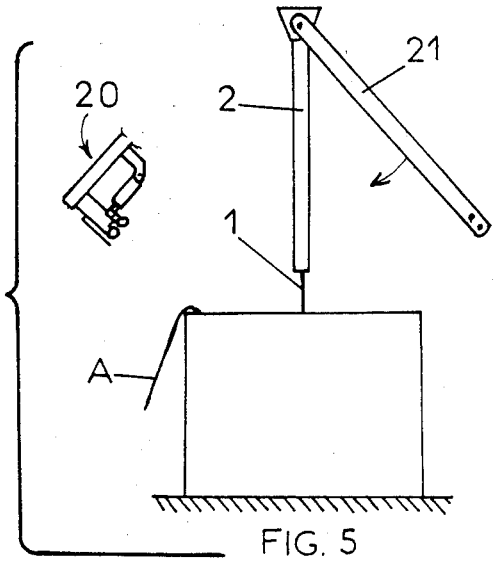
FIGS. 5 to 9 are schematic views showing the various stages of the method according to the invention taking place.

The jaws 14 and 15 open and the end A of the tow is released and falls on the side of the container (FIG. 5).

The member 21, which was in the rest position essentially symmetrical to the member 20, relative to the vertical plane containing the axle 4, moves towards the member 20. The feed apron 7 feeding the tow and the movement of the laying guide 2 are stopped. The guide 2 can be immobilised at any point in its stroke.

Figure 6:
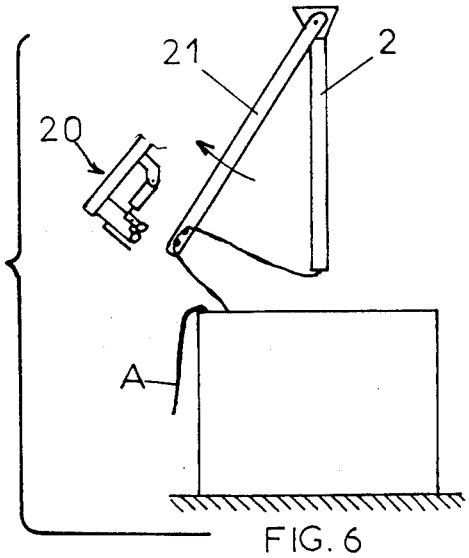
Figure 7:
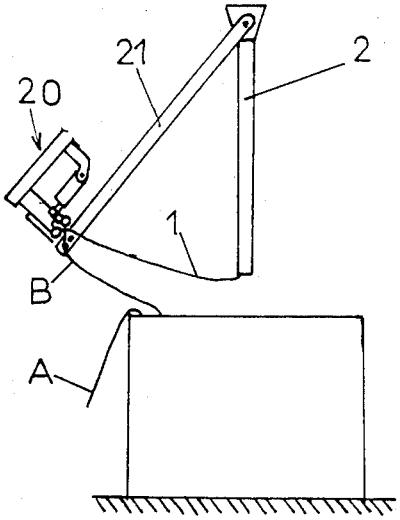

During movement of the member 21 towards the member 20, the bars 12 and 13 of the member 21 contact and effectively seize the tow, downstream of the outlet of the guide 2, and bring it towards the member 20 (FIG. 6).

When it has arrived at the end of its stroke (FIG. 7), the member 21 introduces a portion of tow between the jaws 14 and 15 in the open position, by means of the non-cutting blade 19. In the same step, the portion of tow between the bars 12 and 13 is pressed against the heated cutting blade 16 by these bars.

Figure 8:
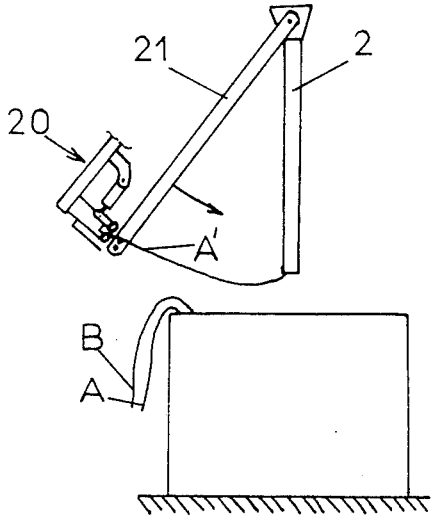

The tow is cut. The end B, originating from the container 3, falls back along the latter on the same side as the end A (FIG. 8).

The movable member 21 starts its return movement and the jaw 15, controlled by the cylinder 17, simultaneously closes again and traps the end A′ of the tow, originating from the feed guide 2. The container 3 is discharged and replaced by an empty container. When the member 21 has reached its rest position, the feed of the tow and the laying guide 2 are restarted in order to fill a new container, the end A′ remaining gripped during the said filling (FIG. 9) and the cycle continues as before.

The method and apparatus according to the invention make it possible for the beginning and the end of the baled length of tow to be readily visible; this facilitates the subsequent use of the tow packaged in this way and makes it possible, for example, to form transfer tails between containers.

Furthermore, by cutting with a heated blade, in the case of tows of thermoplastic textiles, the yarns are welded at the point of cutting and are thus held well together. It is no longer necessary to knot the ends or to use an adhesive tape.

The whole cutting operation, between the end of filling and the start of baling in the new container, has a maximum duration of the order of about ten seconds.

It has thus been possible to bale a tow of continuous filaments of poly-(ethylene glycol)terephthalate having a gauge of 75 kilotex and a width of 130 mm, at 180 meters/minute, the duration of the operations between the end of filling and the start of the new cycle being 7 seconds.

The invention can be applied to the baling of tows of artificial and synthetic yarns, in particular to the baling of tows of thermoplastic yarns.

What is claimed is:

1. In a process for baling a tow of continuous textile filaments in a baling cycle in which a tow is fed to a container having a sidewall by a laying means driven with an oscillating movement between maximum oscillating positions about a median position, the improvement comprising, filling said container while constantly gripping a beginning end of the tow while the tow is being fed to said container by said laying means;

releasing the gripped beginning end of the tow when the filling of the container is completed;

displacing the tow downstream of the oscillating laying means by means of a member driven with a pendular movement, to bring the tow to a fixed means for gripping the tow, the fixed gripping means being located at a position which is beyond the maximum oscillating position of the oscillating laying means;

stopping the feed of the tow and the oscillating movement of the laying means;

automatically cutting the continuous tow originating from outside the container by means of a blade adjacent to the fixed gripping means, to form a beginning end of tow for a new container, that end of the cut tow formed by said automatic cutting, which is integral with the tow located in the container, falling over the sidewall of the container and the newly formed beginning end of tow, integral with the tow fed in through the laying means, being gripped until a new container is filled;

replacing the filled container with a new container; and restarting the feed of the tow and returning the member driven with a pendular movement to a rest position which is essentially symmetrical to the fixed gripping means, relative to the median position in the oscillating movement of the laying means, and filling the new container.

2. A method according to claim 1, wherein when said gripped end is released it also falls over said sidewall of the container.

3. A method according to claim 1 or 2 wherein the tow is formed of thermoplastic filaments, and wherein the cutting is effected by means of a heated blade, causing cutting and welding of the tow at both its cut ends.

4. Apparatus for baling a tow of textile filaments, said apparatus comprising at least one oscillating laying guide capable of oscillating in a zone between maximum oscillating positions, means associated with said oscillating laying guide for feeding the tow vertically through said guide into a container, means for reciprocating the container in a direction perpendicular to that of the oscillation of the laying guide, and a device for automatically cutting the tow when the container is filled with a predetermined amount of said tow, said cutting device comprising a fixed member for gripping the tow, located beyond said zone, a movable member associated with said oscillating laying guide capable of moving from a rest position to a position adjacent to the fixed member for displacing the tow and bringing it to the fixed member, and fixed means associated with said fixed member for cutting the tow, which fixed cutting means is located downstream of the fixed member with respect to the direction of displacement of the tow through said oscillating laying guide.

5. Apparatus according to claim 4, wherein the member for displacing the tow and bringing it to the fixed member comprises at least one arm which is driven, with a pendular movement having an amplitude which is greater than the amplitude of the oscillating movement of the laying guide, between the rest position and the position adjacent to the fixed member, said arm comprising at least one element for displacing the tow downstream of the laying guide, an element for introducing the tow into the gripping means and an element for holding the tow against the cutting means, said holding element being located downstream of the means for introducing the tow.

6. Apparatus according to claim 5, wherein the gripping means comprises a fixed jaw and a movable jaw, and the cutting means comprises a heated blade adjacent to the gripping means.

7. Apparatus according to claim 5 or 6, wherein the element for introducing the tow into the gripping means comprises a non-cutting blade and the element for holding the tow against the cutting means comprises two parallel bars.

8. Apparatus according to any one of claims 4, 5 or 6, wherein the oscillating laying guide oscillates about a pivoting axle and comprises a funnel-shaped guide driven with a pendular movement about a horizontal axle, and the member for displacing the tow and bringing it to the fixed member comprises two parallel arms which are located one on each side of the oscillating laying guide and are joined, at their upper part, by the same pivoting axle as the pivoting axle of the laying guide, and, at their lower part, by two parallel bars, the latter constituting both the element for displacing the tow and the element for holding it against the cutting means.

* * * * *